US006145152A

United States Patent [19]

Ward

[11] Patent Number: 6,145,152

[45] Date of Patent: Nov. 14, 2000

[54] REPLACEABLE HEAD TOOTHBRUSH CONSTRUCTION

[76] Inventor: Peter Martin Ward, 506 Cedarwood Dr., Vineland, N.J. 08360

[21] Appl. No.: 09/236,032

[22] Filed: Jan. 22, 1999

[51] Int. Cl.[7] ..... A46B 9/04

[52] U.S. Cl. ..... 15/176.1; 15/176.6; 15/167.1; 15/145; 132/323; 601/141

[58] Field of Search ..... 15/167.1, 176.1, 15/176.6, 145; 601/141; 132/308, 309, 310, 316, 323; 433/30; 403/325, 328, 327

[56] References Cited

U.S. PATENT DOCUMENTS

| | | | |
|---|---|---|---|
| 1,021,639 | 3/1912 | Smith | 15/316 |
| 3,072,938 | 1/1963 | Phaneuf | 15/176.6 |
| 3,181,189 | 5/1965 | Leyden | 15/145 |
| 3,927,435 | 12/1975 | Moret et al. | 15/176.1 |
| 4,592,109 | 6/1986 | Borea et al. | 15/176.1 |
| 4,880,382 | 11/1989 | Moret et al. | 132/309 |
| 5,010,906 | 4/1991 | Preciutti | 15/167.1 |
| 5,058,230 | 10/1991 | Hodosh et al. | 15/167.1 |
| 5,224,234 | 7/1993 | Aesenault et al. | 15/167.1 |
| 5,247,718 | 9/1993 | Victorian | 15/167.1 |
| 5,261,430 | 11/1993 | Mochel | 132/323 |
| 5,361,446 | 11/1994 | Rufo | 15/167.1 |
| 5,369,835 | 12/1994 | Clarke | 15/167.1 |
| 5,412,831 | 5/1995 | Mongelluzzo | 15/167.1 |
| 5,511,276 | 4/1996 | Lee | 15/167.1 |
| 5,735,691 | 4/1998 | Fetter | 15/145 |
| 5,875,510 | 3/1999 | Lamond et al. | 15/167.1 |

*Primary Examiner*—Robert J. Warden, Sr.
*Assistant Examiner*—Theresa T. Snider
*Attorney, Agent, or Firm*—Henderson & Sturm LLP

[57] ABSTRACT

A replaceable head toothbrush construction 10 including an elongated handle member 20 having a hollow upper portion 24 provided with a contoured central bore 25 having an intermediate portion which defines a peripheral recess 28 and further including a head unit 12 which includes a plurality of head members 50. Each head member 50 comprises a different dental implement 60 such as a toothbrush element 61, a mirror element 62, a flossing element 63, etc. Each dental implement 60 is provided with a downwardly depending shaft 54 having a base segment 55 adapted to be captively engaged in the central bore 25 and the head members 50 and the handle member 20 is further provided with registration means 31, 53.

2 Claims, 2 Drawing Sheets

REPLACEABLE HEAD TOOTHBRUSH CONSTRUCTION

BACKGROUND OF THE INVENTION

1. Field of the Invention

The present invention relates to the field of replaceable head toothbrush constructions in general, and in particular to push button activated replaceable head constructions for toothbrushes.

2. Description of Related Art

As can be seen by reference to the following U.S. Pat. Nos. 5,224,234; 5,247,718; 5,369,835; 5,412,831; and 5,511,276, the prior art is replete with myriad and diverse replaceable head toothbrush constructions even including push button actuated versions.

While all of the aforementioned prior art constructions are more than adequate for the basic purpose and function for which they have been specifically designed, they are uniformly deficient with respect to their failure to provide the simple, efficient, and fail safe alignment and locking mechanism that is employed in the replaceable head toothbrush construction that forms the basis of the present invention.

As most dental care providers are all too well aware, most individuals do not practice proper dental hygiene due to the large number of long handled dental care instruments that are required for prophylactic maintenance.

As a consequence of the foregoing situation, there has existed a longstanding need for a new and improved type of push button actuated replaceable head toothbrush construction that would employ a positive locking and registration system for the replaceable head construction, and the provision of such a construction is a stated objective of the present invention.

BRIEF SUMMARY OF THE INVENTION

Briefly stated, the replaceable head toothbrush construction that forms the basis of the present invention comprises in general, a handle unit adapted to releasably engage a head unit including a plurality of head members wherein each head member comprises a dental implement that performs a different function than the other dental implements.

As will be explained in greater detail further on in the specification, the handle unit includes an elongated handle member having an upper portion which is provided with a contoured central bore whose intermediate portion defines a peripheral recess and whose lower portion is intersected by a transverse bore that is dimensioned to slidably receive a push button element having a spring loaded catch element.

In addition, each of the head members is provided with a downwardly depending shaft element provided with a base segment that is dimensioned to be received in the lower portion of the central recess and engaged by the catch element on the push button element to releasably engage the head member relative to the handle member.

Furthermore, both the handle member and the plurality of head members are provided with registration means to properly orient the head members to the handle member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
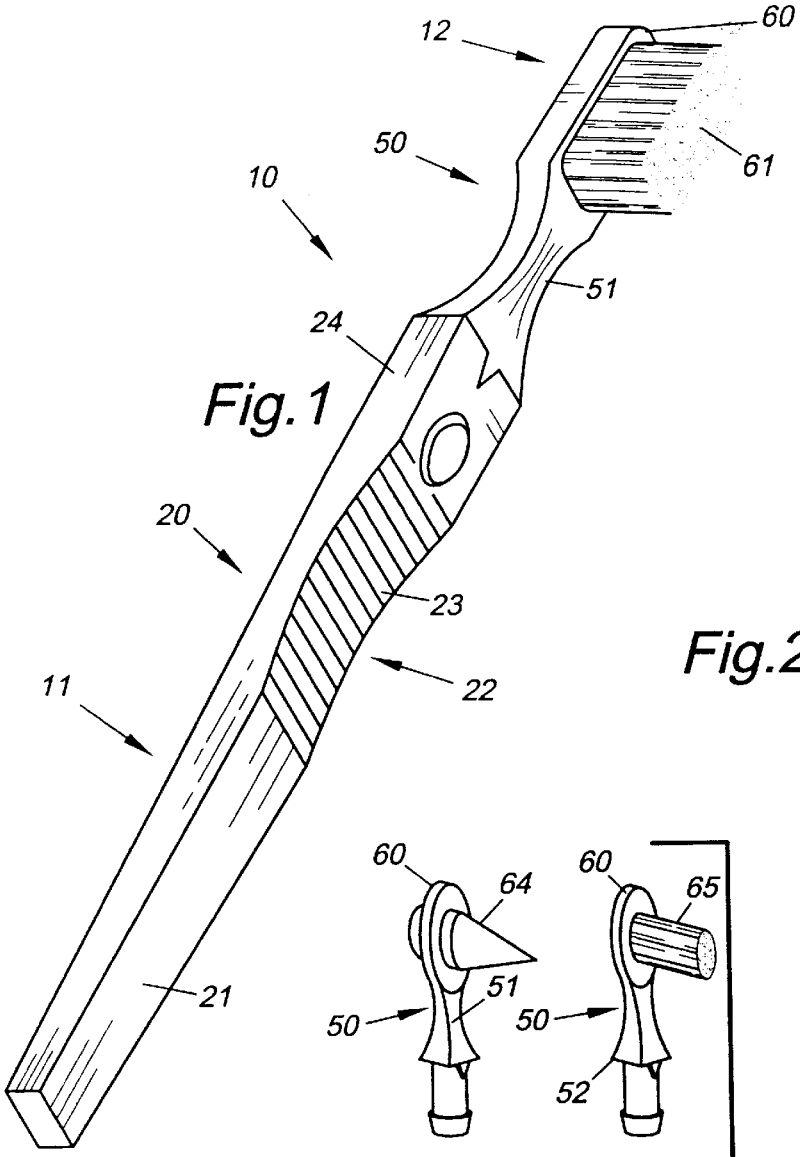
FIG. 1 is a perspective view of one version of the replaceable head construction that forms the basis of the present invention.

As can be seen by reference to the drawings, and in particular to FIG. 1, the replaceable head toothbrush construction that forms the basis of the present invention is designated generally by the reference number 10. The construction 10 comprises in general, a handle unit 11, and a replaceable head unit 12. These units will now be described in seriatim fashion.

Figure 3:
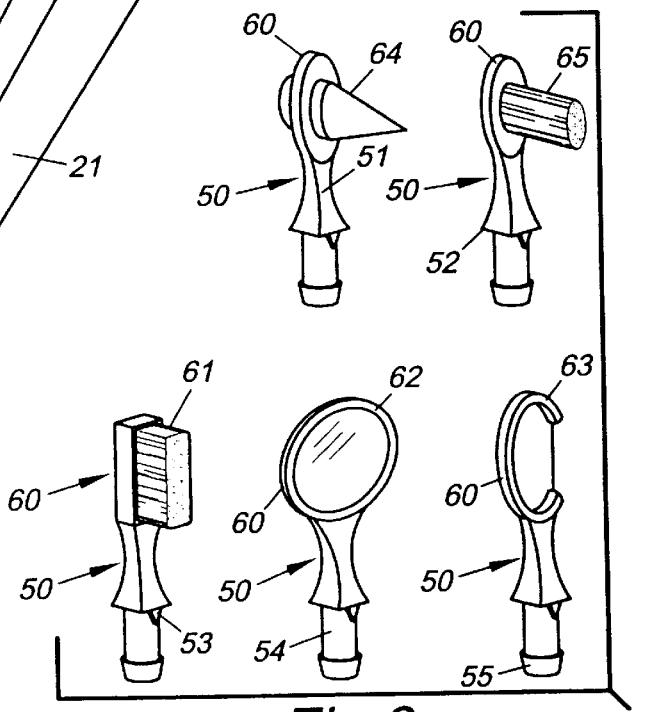
FIG. 3 is a group perspective view of the various head members that comprise the head unit.
Figure 4:
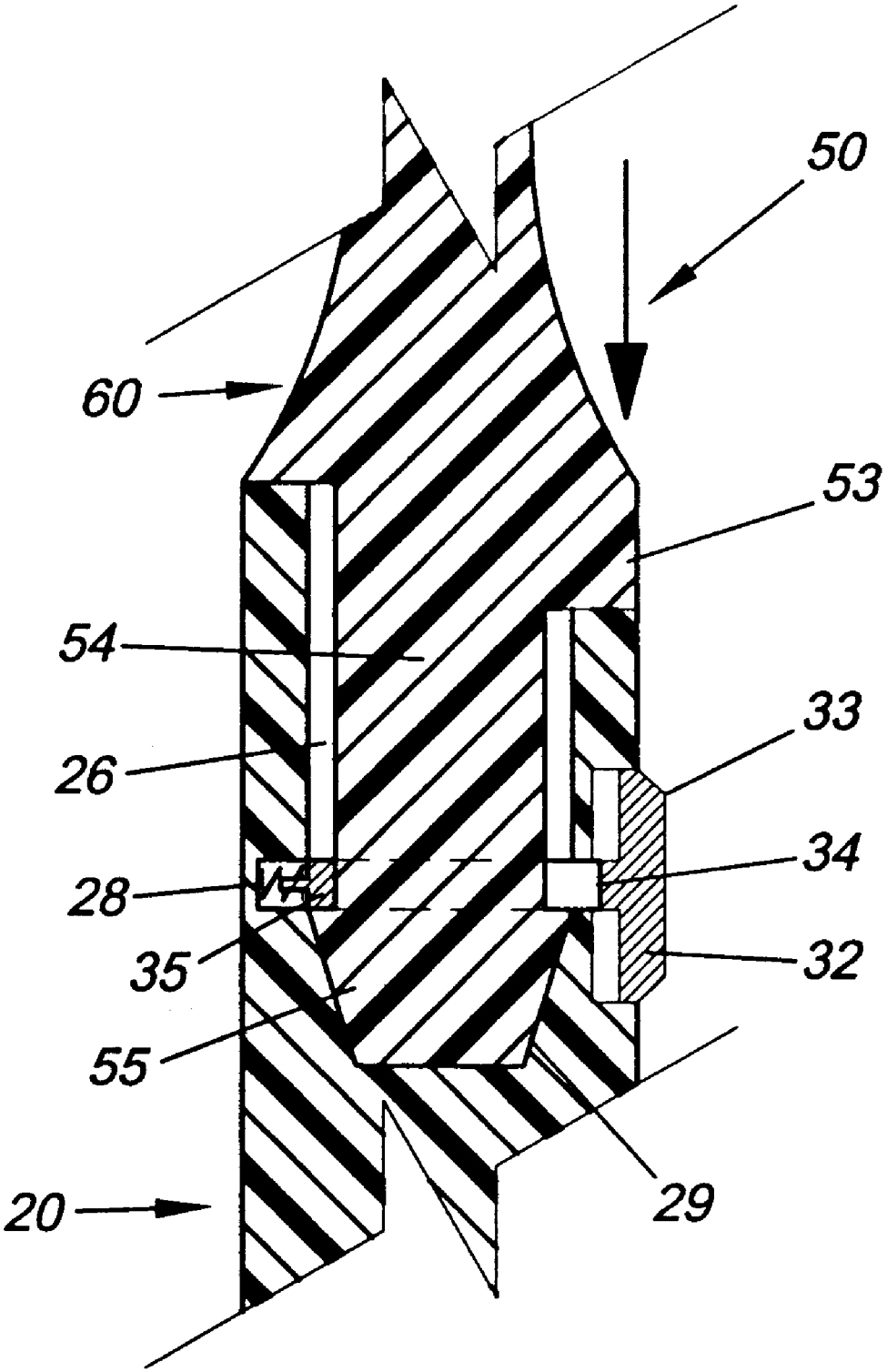
FIG. 4 is a cross sectional view illustrating the forcible push button disengagement between a head member and the upper portion of the handle member.

As shown in FIGS. 1, 3, and 4, the handle unit 11 comprises in general, an elongated contoured handle member 20 having a generally tapered lower portion 21, an intermediate portion 22 provided with a ridged recess 23 and an enlarged hollow upper portion 24.

In addition, the enlarged hollow upper portion is provided with a contoured central bore designated generally as 25. The upper portion 26 of the bore has a generally cylindrical shape, the intermediate portion 27 of the bore has an enlarged truncated cylindrical shape which defines a peripheral recess 28 within the bore and the lower portion 29 of the recess has a generally inverted trapezoidal shape.

As can best be seen by reference to FIGS. 2, and 3, the upper portion 24 of the handle member 20 is further provided with a transverse bore 30 which intersects the lower portion 29 of the central bore 25 and a notch 31 which extends downwardly from the periphery of the top of the handle member 20 and which is preferably vertically aligned with the transverse bore 30 for reasons that will be explained presently.

Turning now in particular to FIG. 4, it can be seen that the transverse bore 30 is dimensioned to slidably receive a push button element 32 having an enlarged head 33 connected on one end of a shaft 34 wherein the other end of the shaft 34 is provided with a spring loaded catch element 35 whose purpose and function will be described presently.

Figure 2:
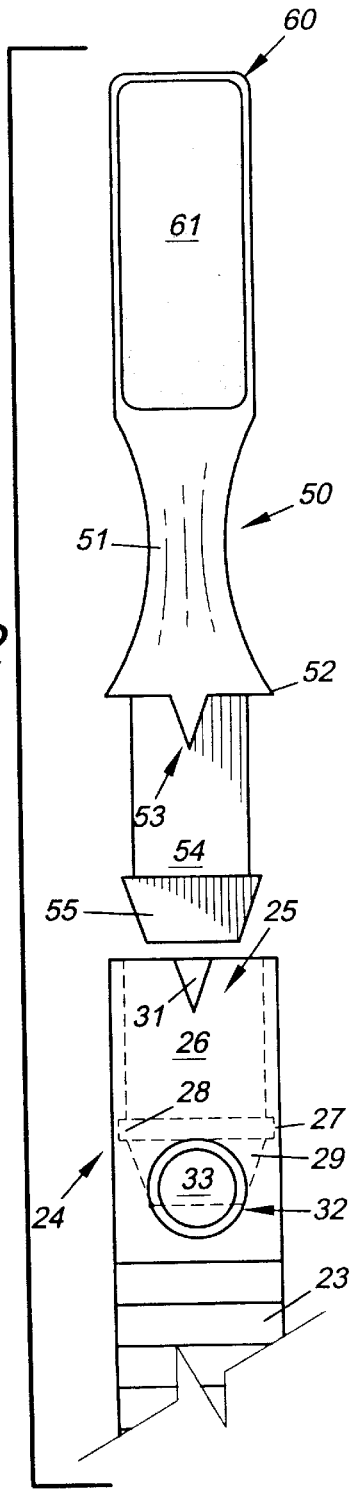
FIG. 2 is an exploded perspective view of one of the head members and the upper portion of the handle unit.

As shown in FIGS. 2 and 3, the replaceable head unit 12 comprises a plurality of head members 50 which all share common structural features with the exception of the specific dental head implement 60 formed on the top of the head member 50. The dental implement 60 may comprise a conventional rectangular shaped toothbrush element 61, a mirror element 62, a flossing element 63, a gum massage element 64, or a conventional cylindrical shaped toothbrush element 65.

Still referring to FIGS. 2 and 3, it can be seen that each head member 50 has a dental implement 60 mounted on top of a tapered neck segment 51 which terminates in a flared skirt portion 52 provided with a downwardly depending projection 53 which is dimensioned to be received in registering engagement with the notch 31 formed in the top of the handle member 20.

In addition, each head member 50 is further provided with an elongated cylindrical shaft element 54 which depends downwardly from and along the longitudinal axis of the neck segment 51. The lower end of the shaft element 54 is provided with a generally inverted trapezoidal shaped base segment 55 which is dimensioned to be received in the inverted trapezoidal shaped lower portion 29 of the central bore 25. The spring loaded catch element 35 will captively engage the base segment 55 in the lower portion 29 of the central bore 25.

Turning now to FIG. 3, it can be seen that when the user wishes to replace one of the dental implements 60 with another dental implement 60, all that is required is to press the enlarged head 33 of the push button element 32 inwardly relative to the handle member 20 which will depress the spring loaded catch element 35 on the push button shaft 34 to release the base segment 55 of the head member 50 from the handle member 20.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A replaceable head toothbrush construction comprising:

a handle unit including an elongated handle member having a lower portion, an intermediate portion and an upper portion wherein the upper portion is provided with a contoured central bore, a transverse bore intersecting a portion of said central bore, and a registration notch formed on the top of said upper portion, p1 a replaceable head unit including a plurality of head members wherein each head member comprises a different dental head implement mounted wherein each individual dental head implement is formed on top of a neck segment having a downwardly depending registration tang dimensioned to be received in the registration notch in the handle member and wherein the neck segment is further provided with a downwardly depending shaft element provided with a base segment which is dimensioned to be received in said central bore and said central bore is provided with an upper portion having an elongated cylindrical shape dimensioned to slidably receive said shaft element, an intermediate portion having an enlarged diameter truncated cylindrical shape defining a peripheral recess within said bore and a lower portion dimensioned to receive said base segment wherein the lower portion of said recess and base segment both have a generally inverted trapezoidal shape; and a push button element having a shaft dimensioned to be received in said transverse bore wherein one end of said shaft is provided with an enlarged head and the other end of said shaft is provided with a spring loaded catch element dimensioned to be received in said peripheral recess and adapted to captively engage the base segment of the head member within the lower portion of said central bore.

2. The construction as in claim 1 wherein said different dental head implements include a toothbrush head element, a mirror element, a flossing element, and a gum massage element.

* * * * *